United States Patent [19]

Vercillo

[11] Patent Number: 4,938,371

[45] Date of Patent: Jul. 3, 1990

[54] CLOSURE HAVING IMPROVED SEALANT CHANNEL FOR RECEIVING SEALANT BY SPIN LINING

[75] Inventor: Peter A. Vercillo, Hinsdale, Ill.

[73] Assignee: Continental White Cap, Inc., Norwalk, Conn.

[21] Appl. No.: 354,294

[22] Filed: May 19, 1989

[51] Int. Cl.[5] ..... B65D 53/06

[52] U.S. Cl. ..... 215/352

[58] Field of Search ..... 215/341, 352, 348, 349, 215/350, 351, 353

[56] References Cited

U.S. PATENT DOCUMENTS

| | | | |
|---|---|---|---|
| 802,003 | 10/1905 | Lorenz | 215/353 |
| 819,236 | 5/1906 | Lorenz | 215/353 X |
| 826,105 | 7/1906 | Honiss | 215/353 X |
| 2,135,635 | 11/1938 | Enkur | 215/44 |
| 2,281,642 | 5/1942 | Ulanet | 215/79 |
| 2,362,009 | 11/1944 | Hogg | 53/421 |
| 3,155,262 | 11/1964 | Cros | 215/46 |
| 3,390,800 | 7/1968 | Simons | 215/40 |
| 3,883,025 | 5/1975 | Jemmett | 215/341 |
| 4,036,388 | 7/1977 | Davidson | 215/341 |
| 4,244,481 | 1/1981 | Kornelis | 215/348 |
| 4,407,422 | 10/1983 | Wilde et al. | 215/246 |
| 4,488,655 | 12/1984 | Hsubo et al. | 215/252 |
| 4,527,705 | 7/1985 | Prades | 215/341 X |
| 4,545,499 | 10/1985 | Bennett et al. | 215/352 |
| 4,570,811 | 2/1986 | Lecinski et al. | 215/352 X |
| 4,603,786 | 8/1986 | Lecinski, Jr. et al. | 215/348 X |
| 4,697,716 | 10/1987 | Mumford | 215/352 |

FOREIGN PATENT DOCUMENTS

| | | | |
|---|---|---|---|
| 1010515 | 6/1952 | France | 215/341 |
| 2457813 | 1/1981 | France | 215/341 |
| 67447 | 2/1942 | Norway | 215/352 |
| 333448 | 5/1954 | Switzerland | 215/352 |
| 1131419 | 10/1968 | United Kingdom | 215/341 |

*Primary Examiner*—Stephen Marcus

*Attorney, Agent, or Firm*—Charles E. Brown; Paul Shapiro; Charles A. Brown

[57] ABSTRACT

This relates to a closure combination which includes the closure being formed with a sealant channel to which there is applied by spin lining a plastisol type compound sealant, or the like. It is preferred, from an economy standpoint, to utilize a minimal amount of the sealant while providing the necessary sealing surface between a container neck finish and the sealant. Since the sealant is applied by a spin lining process during which the closure is rapidly rotated, the sealant is thrown radially outwardly by centrifugal force. However, the viscosity of the sealant normally is such as to prevent it from being returned to a level-flat condition. It has been found that by modifying the sealant channel configuration, particularly the slope of the base wall thereof, depending upon the viscosity of the sealant, one can selectively obtain a uniform thickness sealant application or a flat top sealant application. Further, by sloping the end seal surface of the container to which the closure combination is to be applied, one can obtain extra beneficial results. It is also desirable to provide a dam arrangement for the sealant which permits return overflow of the sealant with the dam accommodating the overflowing sealant.

19 Claims, 2 Drawing Sheets

CLOSURE HAVING IMPROVED SEALANT CHANNEL FOR RECEIVING SEALANT BY SPIN LINING

This invention relates in general to new and useful improvement in closures of the type wherein the required sealant for forming a seal with the container is applied by a conventional spin lining process. Most particularly, the invention has to do with such a closure having a modified sealant receiving channel configuration wherein minimum sealant may be applied with maximum efficiency.

It is well known in the art to form a closure with a peripheral channel of which the closure end panel forms a wall and wherein the required sealant is applied in a spin lining process. In such process, the closure is presented in an inverted position and is rotated while the sealant is being sprayed thereon. The net result of the centrifugal force on the sealant is that the sealant is thrown radially outwardly and has a much greater thickness adjacent the skirt. After the sealant has been applied and rotation of the closure is discontinued, the applied sealant has a tendency to flow radially inwardly, but only very slightly due to the sealant's viscosity.

Further, the sealant is normally of the type which puffs when cured with the puffing being on the order of 100% of the sealant thickness as originally applied. The net result is that the sealant will not return to a level-flat condition after rotation has stopped and this condition is aggravated during the heat carrying due to puffing.

An outwardly increasing slope sealant may in some cases be desirable, but in many cases it is undesirable because it is more difficult to maintain compound thickness specifications during manufacturing; uneven sealant control may cause poor cap/container application in a sealing machine because additional torque and closure-preheating may be required, but not consistently; cap removal torque is increased by an amount roughly proportional to the increased application torque and the additional container/sealant surface contact that must be overcome. Further, additional sealant is required.

In accordance with this invention, it is proposed to modify the channel configuration for the more effective use of the sealant. This may include a dam which permits excess sealant to overflow the dam. It may also include a radially inwardly sloping of the interior wall surface of the skirt adjacent the closure end panel.

Further, and most particularly, the modification of the sealant channel configuration may include the interior surface of the end panel between the dam and the skirt being sloped downwardly towards the dam.

With the above and other objects in view that will hereinafter appear, the nature of the invention will be more clearly understood by reference to the following detailed description, the appended claims, and the several views illustrated in the accompanying drawings.

Figure 1:
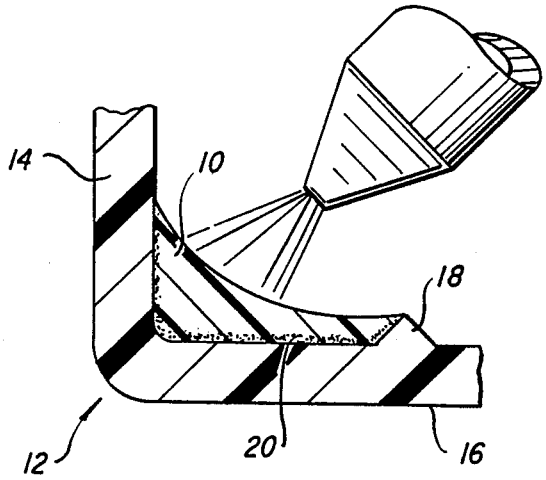
FIG. 1 PRIOR ART
FIG. 1 is a fragmentary sectional view showing a conventional closure construction and a sealant applied by a spin lining process.
Figure 2:
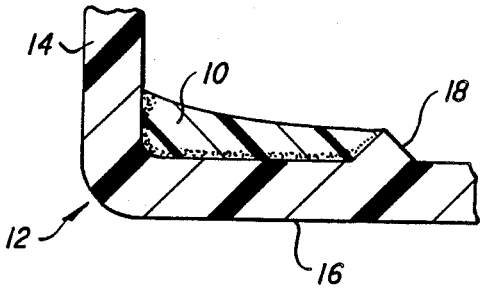
FIG. 2 PRIOR ART
FIG. 2 is a fragmentary sectional view similar to FIG. 1 and shows the sealant after the application of the sealant and discontinuation of the spinning of the closure with the applied sealant having flowed backward a minimum amount.
Figure 3:
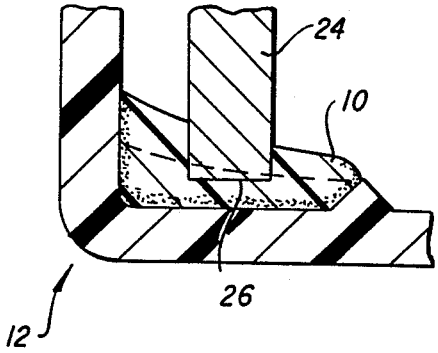
FIG. 3 PRIOR ART
FIG. 3 is another fragmentary sectional view showing the closure and sealant of FIG. 2 after the sealant has been cured and a puffing on the order of 100% has been effected.
Figure 4:
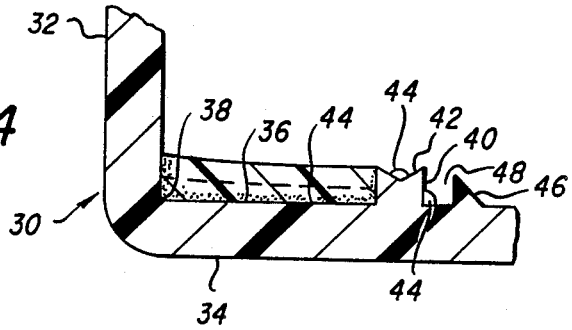
FIG. 4 is a fragmentary sectional view of an improved closure wherein in lieu of the usual rib-like dam, there is provided an inner dam having a grooved free end for receiving excess sealant and a radially inner rib for defining a further receptacle for overflowing sealant, the original surface the sealant being shown in dotted lines and the sealant being shown in its cured and puffed state.

Reference is first made to the prior art showings of FIGS. 1–3. In FIG. 1 there is illustrated the manner in which a plastisol type sealant 10 is applied to a closure generally identified by the numeral 12. The closure 12 is preferably formed of injection molded plastic and includes a cylindrical skirt 14 and an end panel 16. The end panel is provided with a rib 18 which together with a radially outer portion of the end panel 16 and an adjacent portion of the skirt 14 define a sealant receiving channel 20.

The closure 12, in its inverted position, is mounted in a suitable rotating support and while the closure 12 is being rotated, the sealant 10 is sprayed into the channel 20 by means of a spray head 22. Due to the centrifugal force, the flowable sealant 10 is generally urged radially outwardly and upwardly along the interior of the skirt wall 14 to the configuration shown in FIG. 1. Then, when the rotation of the closure 12 stops, it returns only slightly towards a level-flat condition and that the sealant's viscosity prevents it from returning.

Plastisol type sealants normally puff (expand) during a heat curing process by an approximate predetermined percent rate. For example, as best shown in FIG. 3, during curing the sealant 10 may puff 100% so that in all areas it doubles its thickness. The net result is that the thicker outer portion of the sealant 10, after the puffing, will have an even more exaggerated thickness. Thus, when the closure 12 is applied to a container 24, and the end seal surface 26 of the container neck finish is pressed into the sealant 10 to the desired depth, as is also shown in FIG. 3, a normally undesirable condition exists. Although an outwardly increasing sloped sealant may in some cases be desirable, in most cases it is undesirable because: it is more difficult to maintain compound thickness specification during manufacturing, uneven sealant control may cause poor closure/container application at the sealing machine because additional torque and closure pre-heating may be required, but not consistently; closure removal torque is increased by an amount roughly proportional to the increased application torque and the additional container/sealant surface contact that must be overcome as shown in FIG. 3; and additional unnecessary sealant is required.

Reference is now made to an improved closure configuration, which closure is generally identified by the numeral 30 The closure 30, like the closure 12, includes a generally cylindrical skirt 32 and an end panel 34. While the exterior of the connection between the end panel 34 and the skirt 32 is rounded as in the case of the closure 12, the closure 30 has a sealant channel 36 of a modified configuration. First of all, the interior corner 38 between the skirt 32 and the end panel 34 is a sharp square corner as opposed to the rounded corner of the prior art closure 12. Secondly, in lieu of the rib 18, the closure 30 is provided with a dam configuration including a relatively broad dam 40 which is provided in the upper surface thereof with a groove 42 for receiving sealant as at 44 which may overflow the dam 40. In addition, radially inwardly of the dam 40 there is an upstanding rib 46 which defines a second receptacle 48 for the overflowing sealant 44.

Like the closure 12, the channel 36 is spin lined with the sealant 44 to the height controlled by the dam 40. Thereafter, the sealant 44 may be cured and puffed in the normal manner, not illustrated. The configuration of the sealant channel 36 is of a configuration that helps to maintain the more level fill by spin lining utilizing a plastisol type sealant. It can be seen that the outermost corner 38, being sharp, reduces the tendency for the sealant to climb upward because of the centrifugal force of the rotating closure.

Figure 5:
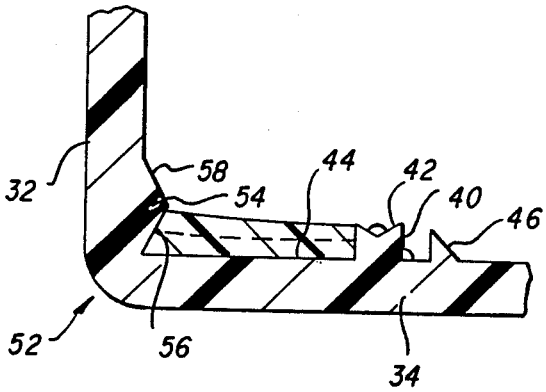
FIG. 5 is another sectional view taken through a closure similar to that of FIG. 4 but wherein in order to restrict flow of the sealant along the inner surface of the closure skirt, the closure skirt is provided with a radially inwardly sloping surface to be engaged by the applied sealant, the originally applied condition of the sealant being shown by dotted lines.

In FIG. 5 there is illustrated a slightly modified form of the closure 30, the closure of FIG. 5 being generally identified by the numeral 52. In lieu of the sharp corner 38, the wall of the skirt is provided internally with a projection 54. The projection 54 presents an inwardly tapering wall 56 adjacent the intersection of the skirt 32 with the end panel 34 for a certain distance away from the end panel 34, after which the projection 54 slopes as at 58 back towards the skirt 32. It will be apparent that the surface 56 which provides for a sloped sidewall angle serves to further reduce the upward travel of the sealant during a spin lining of the closure.

With respect to the closures 30 and 52, a proper sealant thickness level is maintained by a predetermined height of the dam 40 during the spin lining. Excess sealant backflows over the dam 40 and into the receptacle defined by the annular groove 42. Additional excess sealant flow beyond the dam 40 will be into the receptacle 48 between the dam 40 and the rib 46.

Figure 6:
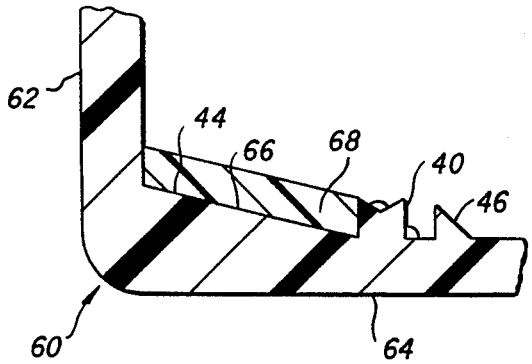
FIG. 6 is another fragmentary vertical sectional view showing a modified form of closure wherein the closure is provided with the dam construction shown in FIG. 4 and wherein between the dam and the skirt the inner surface of the end panel slopes from the skirt towards the dam, the view showing the sealant as applied.
Figure 7:
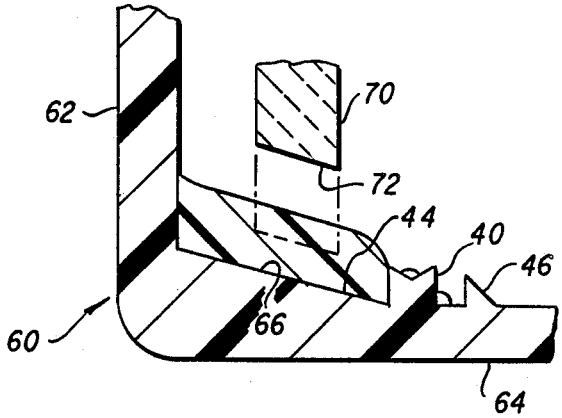
FIG. 7 is a sectional view similar to FIG. 6 wherein the sealant has been cured and puffed and there being illustrated a seal forming end of a container to which the closure is to be applied, the relationship of the clOsure With respect to the container when the closure is applied being shown in dotted lines.
Figure 8:
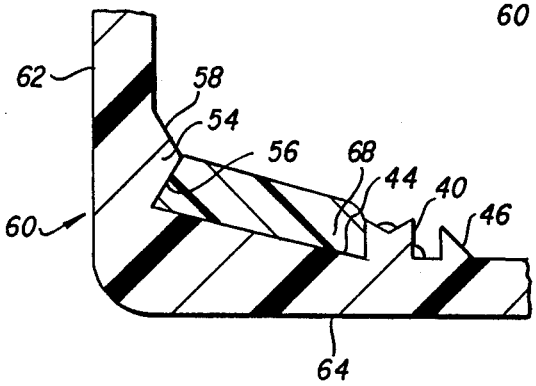
FIG. 8 is a sectional view similar to FIG. 6 with the sealant applied in the channel and cured and puffed, and wherein the skirt has a radially inwardly sloping inner surface for restricting the axial flow of sealant as it is being applied in a spin-spray process.

If high viscosity still prevents sufficient backflow of the sealant after the spin lining and the result is that the upper surface of the applied sealant 44 slopes outwardly at an angle, then a constant thickness of the sealant can be obtained by utilizing the closure configuration shown in FIG. 6, the closure being generally identified by the numeral 60. The closure 60 includes the usual skirt 62 and an end panel 64. The end panel has integrally formed therewith the dam 40 and the rib 46. However, instead of the end panel 64 continuing to be planar on the inner surface thereof between the dam 40 and the skirt 62, the end panel slopes outwardly as at 66 so that there is defined between the dam 40 and the skirt 62 a sealant receiving channel 68 having an outwardly sloping bottom wall defined by the surface 66. The slope of the surface 66 will be determined by the angle which the sealant 44 normally will maintain Thus when the sealant 44 is applied to the closure 60 as shown in FIG. 6, the sealant 44 will substantially be of a uniform thickness, even if the high viscosity of the sealant will still prevent sufficient backflow after spin lining. The sealant 44 is cured and puffed to the configuration shown in FIG. 7, after which the closure is ready to be applied to a container neck finish as is generally shown in FIG. 7, the neck finish being identified by the numeral 70. The neck finish 70, however, instead of having a flat end seal is provided with an outwardly sloping end seal 72 which slopes at the same angle as the surface 66 and thus is parallel to the surface 66 and substantially parallel to the upper surface of the cured and puffed sealant 44.

Further, if desired, in lieu of a sharp corner between the inner surface of the skirt 62 and the end panel 64, as shown in FIGS. 6 and 7, the inner surface of the skirt 62 adjacent the channel 68 may be provided with an internal projection such as the projection 54 with the surfaces 56 and 58 as shown in FIG. 5.

Figure 9:
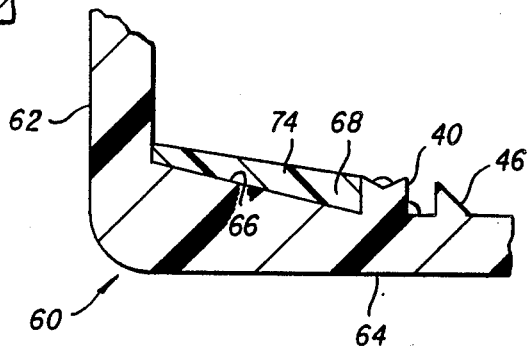
FIG. 9 is a fragmentarly sectional view taken through a closure similar to that of FIG. 6 but wherein the sealant is applied to a greater thickness adjacent the dam and a lesser thickness adjacent the closure skirt.
Figure 10:
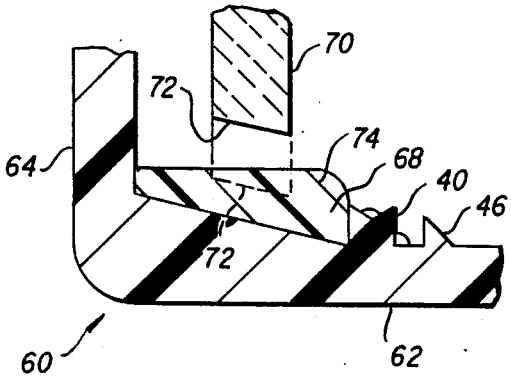
FIG. 10 is a sectional view through the closure and sealant of FIG. 9 after the sealant has been cured and puffed and a container having a tapered end seal surface is about to have applied thereto the closure, the container being shown in its closure applied position in dotted lines.

On the other hand, if the viscosity of the sealant is such that the spin lining process will yield a relatively flat sealing surface, after curing, with an angled sealing channel base, even greater results can be obtained. Thus with reference to FIG. 9, if the sealant channel 68 of the closure 60 can be filled with the sealant 74 which has a greater depth after spin lining adjacent to the dam 40 than adjacent the inner surface of the skirt 62, and taking into consideration the puffing of the sealant 74 during curing, it will be seen that the cured sealant as shown in FIG. 10 will have a substantially level top surface even though the sealant channel 68 has a sloping base or bottom wall 66. The closure combination including the closure 60 and the sealant 74 would then be most efficient, particularly when utilized with the container neck finish 70 having a sloping seal end 72. It will be seen from the dotted lines showing that the penetration of the container neck finish 70 into the sealant 44 will be a maximum at the inner surface of the neck finish and a minimum at the outer surface thereof.

The closure combination of FIG. 10 provides for the following benefits:

1. Easier Closure Application:

The sharper, more pointed, sealing surface initially contacting the sealant forms an easier more immediate impression with less application torque.

2. Sealant "Cut-Through" Resistance Is Improved:

With increased cap application torque, or top loads caused by warehouse pallet stacking, shipping or the like, the similar angles increase the cross sectional width of the sealing surface, thus, distributing the load over a wider sealing surface.

3. Cap Removal Torque Can Be Reduced:

Removal torque can be controlled more easily because less sealant surface contact (wrap) is attained on the outside region of the container sealing surface, while the inside region impression depth is controlled by the dam height and percent puff.

Although only several preferred embodiments of the closure combination has been specifically illustrated and described herein, it is to be understood that minor variations may be made in the closure combination without departing from the spirit and scope of the invention as defined by the appended claims.

I claim:

1. A closure for containers, said closure comprising a skirt open at one end for receiving a container and having an end panel at an opposite end of said skirt, said end panel carrying a dam spaced from said skirt and projecting from said end panel into an interior of said closure, said skirt, said dam and a portion of said end panel between said skirt and said dam defining a channel for a sealant, and said end panel portion having a surface opening into said closure with said end panel portion surface sloping from said skirt toward said dam with said channel being of greatest depth adjacent said dam.

2. A closure according to claim 1 wherein the height of said slope is greater than the height of said dam.

3. A closure according to claim 1 wherein said dam has a grooved free end defining a receptacle for excess sealant.

4. A closure according to claim 3 wherein said end panel carries a projecting rib spaced radially inwardly from said dam and there is a second receptacle for excess sealant between said dam and said rib.

5. A closure according to claim 1 together with a sealant filling said channel.

6. The closure of claim 5 wherein said sealant is a puffed cured sealant.

7. A closure according to claim 1 together with a sealant filling said channel and having a generally planar container engaging surface.

8. The closure of claim 7 wherein said sealant is seated on an end seal surface of a container neck finish, said end seal surface sloping generally frustoconical like and as opposed to being curved being generally parallel to said sloping end panel portion.

9. A closure according to claim 1 together with a sealant filling said channel, said sealant having a container engaging surface disposed generally parallel to said sloping end panel portion.

10. The closure of claim 9 wherein said sealant is a puffed cured sealant.

11. The closure of claim 9 wherein said sealant is seated on an end seal surface of a container neck finish, said end seal surface sloping generally frustoconical like and as opposed to being curved being generally parallel to said sloping and panel portion.

12. A closure according to claim 1 wherein said skirt is cylindrical and said channel is in part defined by a radially inwardly projecting sloping surface of a projection on said skirt.

13. A closure for containers, said closure comprising a skirt open at once end for receiving a container and having an end panel at an opposite end of said skirt, said end panel carrying a dam spaced from said skirt and projecting from said end panel into an interior of said closure, said skirt, said dam and a portion of said end panel between said skirt and said dam defining a channel for a sealant, and said dam having a grooved free end defining a receptacle for excess free sealant.

14. A closure according to claim 13 wherein said end panel carries a projecting rib spaced radially inwardly from said dam and there is a second receptacle for excess sealant between said dam and said rib.

15. The closure of claim 13 wherein said channel is filled with a sealant.

16. The closure of claim 13 wherein said channel is filled with a sealant, having a generally planar container engaging surface.

17. The closure of claim 15 wherein said sealant is a puffed cured sealant.

18. The closure of claim 13 wherein said channel is filled with a sealant of a generally uniform thickness.

19. A closure according to claim 13 wherein said channel is in part defined by a radially inwardly projecting sloping surface of said skirt.

* * * * *